United States Patent [19]

Heitmann

[11] 4,010,911

[45] Mar. 8, 1977

[54] SPLICING APPARATUS FOR WEBS OF METALLIC FOIL OR THE LIKE

[75] Inventor: Bob Heitmann, Hamburg, Germany

[73] Assignee: Hauni-Werke Korber & Co., KG, Hamburg, Germany

[22] Filed: Nov. 13, 1975

[21] Appl. No.: 631,850

[30] Foreign Application Priority Data

Dec. 6, 1974 Germany ..... 2457714

[52] U.S. Cl. ..... 242/58.4; 156/505

[51] Int. Cl.[2] ..... B65H 19/16

[58] Field of Search ..... 242/58.1, 58.3, 58.4, 242/58.5; 156/502, 504, 505, 507, 159

[56] References Cited

UNITED STATES PATENTS

| | | | |
|---|---|---|---|
| 3,030,043 | 4/1962 | Pinkham | 242/58.3 |
| 3,103,320 | 9/1963 | Huck | 242/58.3 |
| 3,730,811 | 5/1973 | Wendf | 242/58.3 |
| 3,925,131 | 12/1975 | Krause | 242/58.4 X |

*Primary Examiner*—Edward J. McCarthy
*Attorney, Agent, or Firm*—Peter K. Kontler; John Kurucz

[57] ABSTRACT

Apparatus for splicing a running web to the leader of a fresh web by means of a uniting band both sides of which are coated with adhesive has a holding device which is placed between the running web and the leader of the fresh web while such leader adheres to suction ports of one of two stationary positioning devices. Two hammers are mounted at the opposite sides of the path for the running web and are movable toward each other to press the running web and the leader of the fresh web against opposite sides of the uniting band in the holding device. The hammers carry mobile cutters which cooperate with complementary cutters, and mobile knives which can cooperate with a fixed knife on the holding device. The arrangement is such that, when a pneumatic motor causes the hammers to move toward each other, the mobile cutter for the fresh web cooperates with the respective complementary cutter to trim the leader of the fresh web ahead of the holding device and th mobile knife for the running web cooperates with the fixed knife to sever the running web behind the uniting band. The holding device is thereupon reoriented and a new uniting band is attached thereto to thus prepare the apparatus for the next splicing operation. The remnant of the roll of running web is replaced with a roll of fresh web and the leader of such web is threaded through the apparatus and attached to the corresponding positioning device. The diameters of rolls can be monitored to automatically arrest the advancing rolls for the running web and to start the pneumatic motor when the supply of running web is depleted.

11 Claims, 5 Drawing Figures

VALVE

SPLICING APPARATUS FOR WEBS OF METALLIC FOIL OR THE LIKE

BACKGROUND OF THE INVENTION

The present invention relates to splicing apparatus for webs of flexible sheet material including paper, cardboard, imitation cork, metallic foil, plastic foil or the like. More particularly, the invention relates to improvements in apparatus for automatically splicing a running web to the leader of a fresh web while the running web is advanced at full or reduced speed or while the running web is arrested.

U.S. Pat. No. 3,030,043 discloses a splicing apparatus wherein the leader of a fresh web is held by a first positioning device at one side of the path for the running web while a second positioning device at the other side of the path is idle. The patented apparatus further comprises means for advancing the running web (i.e., for causing an expiring roll to pay out the running web) and two severing devices one of which is actuatable to sever the running web behind the splice immediately prior, during or subsequent to making of a splice between the running web and the leader of a fresh web. Still further, the patented apparatus comprises a splicer with two splicing sections which are movable, one at a time, to thereby attach the leader of the fresh web to the running web. Splicing apparatus of the just described character are used when the supply of fresh web forms a very large and bulky roll which is hard to handle, i.e., when the fresh roll is not shifted to the position previously occupied by an expired roll. Such apparatus are also preferred in machines where the space which is allotted for the splicing means is not sufficient to allow for shifting of rolls prior and/or subsequent to splicing. When a section of the splicer is set in motion, it causes the running and fresh webs to adhere to opposite sides of a uniting band both sides of which are coated with adhesive. The other section of the splicer serves as an anvil or back support which limits the extent of sidewise movement of webs with the moving section. The patented apparatus does not have any means for trimming the leader of a fresh web prior to splicing with the leader of a fresh web, and each section of the splicer receives motion from a discrete drive. Discrete drives for the sections of the splicer contribute to the cost and space requirements of the apparatus and necessitate the use of a complex control system if the splicing operation is to be carried out in automatic response to depletion of the supply of running web. The absence of trimming means can cause serious problems when the material of the webs is very sensitive, e.g., when the material is a thin metallic foil or a thin transparent plastic foil which is likely to wrinkle and/or undergo other types of deformation. In fact, it is practically impossible to thread the leader of a thin metallic or plastic foil through the apparatus without any wrinkling. If the deformed portions of the leader of a fresh web are not removed, the corresponding portions of the processed web must be detected and ejected from the machine which receives the running web. Typical examples of such machines are packing machines for cigarettes or the like wherein metallic foils are converted into blanks for the making of inner envelopes of cigarette packs and plastic foils are converted into transparent outer envelopes which are normally provided with customary tear strips. A pack having a defective (e.g., deformed) inner or outermost envelope must be segregated from other packs; this can entail substantial losses in output, especially in a modern packing machine which is designed to receive and process the output of one or more high-speed cigarette makers capable of turning out up to and in excess of 70 cigarettes per second.

SUMMARY OF THE INVENTION

An object of the invention is to provide a simple, compact, inexpensive, rugged and reliable splicing apparatus which can be used with particular advantage for splicing of readily deformable webs consisting of paper, cardboard, imitation cork, metallic foil, synthetic plastic sheet material or the like.

Another object of the invention is to provide a splicing apparatus wherein the leader of a fresh web is automatically trimmed prior to attachment to a running web and wherein the leader of a fresh web can be readily threaded through the apparatus to assume a position in which the trimming operation invariably results in the formation of a satisfactory trimmed leader which can be attached to a running web with a high degree of reproducibility.

A further object of the invention is to provide a novel and improved splicer for use in an apparatus of the above outlined character and to provide the apparatus with novel and improved means for holding uniting bands in an optimum position for attachment to fresh and running webs.

An additional object of the invention is to provide a splicing apparatus which can be used with advantage in existing cigarette packing and like machines as a superior substitute for presently known splicing apparatus and which is capable of forming a satisfactory splice while the running web is transported at full speed or at a reduced speed or while the running web is idle.

The apparatus of the present invention is utilized for attaching a running web (e.g., a continuous web of metallic foil) which is withdrawn from a first source of supply (e.g., a roll of convoluted metallic foil) to the leader of a fresh web which is stored in a second source of supply. The means for attaching the running web to the leader of the fresh web is a uniting band which is adhesive at both sides. The apparatus comprises means for advancing the running web along a predetermined path (such advancing means may comprise two rollers one of which is driven, either continuously or intermittently, and the other of which is biased toward the one roller), first and second positioning means which are disposed at the opposite sides of the path for the running web and have suction ports or analogous means for holding the leaders of webs (thus, when the running web is being withdrawn from the respective source, the leader of the fresh web is held by the second positioning means), first and second severing means disposed (either entirely or in part) at the opposite sides of the path and being actuatable to sever the respective webs intermediate the corresponding sources and the advancing means (the arrangement is preferably such that one of the severing means is ineffective when the respective web is a fresh web to thus insure that the fresh web cannot be severed between the respective source and its leader when the severing means are actuated), a splicer having first and second sections (e.g., suitably configurated impellers or hammers) which are actuatable to move toward and away from each other intermediate the positioning means and the source, the path for the running web and the leader of the fresh web being located between the two sections of the splicer, means for holding a uniting band in such position that the band is located between the running and fresh webs as well as between the two sections of the splicer, and means (e.g., a pneumatically operated cylinder and piston unit) for actuating the sections of the splicer and the severing means whereby the sections attach the running and fresh webs to the respective sides of the uniting band and the first severing means severs the running web intermediate the uniting band and the first source. The fresh web then becomes the running web and the remnant of the original running web is removed to provide room for a supply of fresh web whose leader is threaded through the apparatus so that it is held by the first positioning means.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
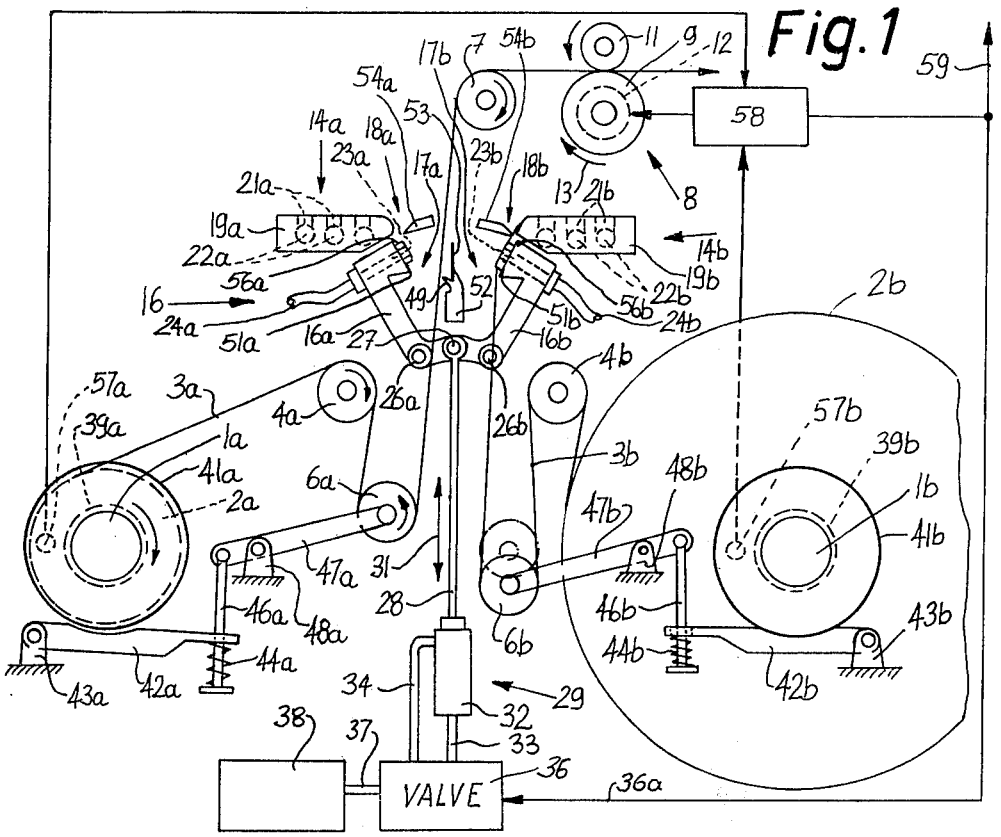
FIG. 1 is a schematic elevational view of an apparatus which embodies the invention.

The apparatus of FIG. 1 comprises two substantially mirror symmetrical halves. The plane of symmetry is assumed to be a vertical plane including the horizontal axis of a coupling pin 27 between two sections 16*a* 16*b* of a splicer 16. The letters *a* and *b* are respectively used to denote the component parts of the lefthand and right-hand halves of the apparatus.

The source of supply of a running web 3*a* is a roll 2*a* which is rotatably mounted on a horizontal spindle 1*a*. The source of supply of a fresh web 3*b* is a roll 2*b* which is rotatable on a second horizontal spindle 1*b*. The material of the webs 3*a*, 3*b* is assumed to be a metallic foil (e.g., aluminum foil), and the web 3*a* is assumed to be converted into a succession of blanks which, in turn, are converted into inner envelopes of cigarette packs in a suitable packing machine. The means for advancing the running web 3*a* along a predetermined path toward a cutting mechanism (not shown) which subdivides the web into portions or blanks of required size comprises a drive 8 including a driven roller 9 and a second roller 11 which is biased toward the roller 9 by suitable springs or the like. The running web 3*a* passes through the nip of the rollers 9, 11 and on toward the aforementioned cutting mechanism. The path for the web 3*a* between the roll 2*a* on the spindle 1*a* and the rollers 9, 11 is defined by a fixedly mounted first guide roller 4*a*, a movable second guide roller 6*a* and a fixedly mounted third guide roller 7. The rollers 4*a*, 6*a*, 7 are idler rollers and the path portion between the rollers 6*a*, 7 is substantially vertical. The driven roller 9 receives torque from the prime mover (not shown) of the packing machine through the medium of a clutch 12 which can be disengaged to deactivate the drive 8. The direction in which the roller 9 is driven when the clutch 12 is engaged is indicated by an arrow 13.

The apparatus further comprises two positioning devices 14*a*, 14*b* which are mounted at the opposite sides of the path for the web 3*a* between the guide rollers 6*a*, 6*b* on the one hand and the guide roller 7 on the other hand; the aforementioned splicer 16 with its sections 16*a*, 16*b* each of which can be said to constitute a hammer or impeller; two severing devices 17*a*, 17*b* disposed at the opposite sides of the path for the running web 3*a;* and two trimming devices 18*a*, 18*b*. The sections 16*a*, 16*b* of the splicer 16 serve to attach the webs 3*a*, 3*b* to the opposite sides of a uniting band 53 a portion of which adheres to a supporting or holding device 52. The severing device 17*a* serves to sever the running web (3*a* in FIG. 1) behind the splice which is obtained when the webs 3*a*, 3*b* adhere to the uniting band 53, and the severing device 17*b* serves to sever the web 3*b* behind a splice when the web 3*b* is running, i.e., when the rollers 9, 11 advance the web 3*b* toward the aforementioned cutting mechanism of the packing machine. The device 18*b* serves to trim the leader 3B (see FIG. 2) of the fresh web 3*b* between the holder 52 and the positioning device 14*b*. The device 18*a* trims the leader 3AA of a fresh web 3*a'* (FIG. 5) which replaces the running web 3*a* after the making of a splice between the webs 3*a* and 3*b*.

The positioning device 14*a* comprises a plate-like member 19*a* the upper side of which has one or more suction ports 21*a* communicating with channels or bores 22*a* which are connected to a suitable suction generating device (not shown), e.g., to the suction intake of a fan. The positioning device 14*b* is a mirror image of the device 14*a* and includes a plate-like member 19*b* with one or more suction ports 21*b* and one or more channels 22*b*. The leader 3B of the fresh web 3*b* is held by the positioning device 14*b* in that the underside of such leader is attracted to the upper side of the member 19*b* by suction ports 21*b*. By threading the fresh web 3*b* in a manner as shown in FIG. 1, i.e., by training the leader 3B around the guide rollers 4*b*, 6*b* and by placing the foremost portion of the leader onto the member 19*b*, the person in charge insures that the apparatus is ready for automatic splicing of the webs 3*a*, 3*b* to each other as soon as the diameter of the expiring roll 2*a* is reduced to a predetermined minimum value.

The sections or hammers 16*a*, 16*b* of the splicer 16 are mounted between the positioning devices 14*a*, 14*b* and the guide rollers 6*a*, 6*b*. These sections have retaining or attracting means in the form of suction ports 23*a*, 23*b* which are connected with a suitable suction generating device (not shown) by means of flexible hoses 24*a*, 24*b*. The purpose of the port or ports 23*a* is to attract the leader 3AA of a fresh web 3*a'* which replaces the running web 3*a* subsequent to the making of a splice between the webs 3*a*, 3*b*. The port or ports 23*b* can attract the adjacent portion of the leader 3B of the fresh web 3*b* but without any effect upon the operation of the splicer because the force with which the rollers 9, 11 transport the web 3*b* forwardly subsequent to splicing suffices to insure that the web 3*b* becomes separated from the splicer section 16*b* as soon as the latter reassumes the position shown in FIG. 1. The suction generating means which is connected with the hoses 24*a*, 24*b* may but need not be that suction generating means which is connected with the channels 22*a*, 22*b* of the positioning devices 14*a*, 14*b*.

The sections 16*a*, 16*b* are respectively pivotable on fixed pivot pins 26*a*, 26*b* and resemble two-armed levers the longer arms of which are respectively formed with the ports 23*a*, 23*b* and the shorter arms of which are coupled to each other by the aforementioned pin 27. The openings of the sections 16*a*, 16*b* through which the coupling pin 27 extends are elongated slots, not shown. The pin 27 is connected to the upper end portion of a piston rod 28 forming part of an actuating means 29 for the splicer 16. The piston rod 28 is reciprocable in directions indicated by a double-headed arrow 31. The actuating means 29 further comprises a fixedly mounted double-acting pneumatic cylinder 32 for a piston which is connected with the lower end portion of the piston rod 28. The upper and lower chambers of the cylinder 32 are respectively connected with conduits 34, 33 which can receive compressed gaseous fluid (e.g., air) from a source 38 by way of a solenoid-operated regulating valve 36. The valve 36 admits gas into the conduit 34 when the conduit 33 communicates with the atmosphere, and vice versa. The reference character 37 denotes a conduit which connects the valve 36 with the source 38. The conductor means which connects the solenoid of the valve 36 with a control circuit 58 is shown at 36*a*.

The roll 2*a* of running web 3*a* rotates with a bearing sleeve 39*a* which surrounds the spindle 1*a*. The sleeve 39*a* is rigid with a brake cylinder 41*a* which can be engaged and braked by a shoe 42*a* to thereby stop the roll 2*a*. The shoe 42*a* is pivotably mounted on a bracket 43*a* and has a hole for a rod 46*a* the upper end portion of which is articulately connected to one arm of a two-armed lever 47*a*. The lever 47*a* is pivotable with respect to a bearing member 48*a* and its right-hand arm carries the guide roller 6*a*. A helical spring 44*a* surrounds the rod 46*a* below the shoe 42*a* and serves to urge the latter against the cylinder 41*a*. When the tension of the web 3*a* increases, i.e., when this web is advanced by the rollers 9, 11, the guide roller 6*a* is caused to rise whereby the lever 47*a* pivots counterclockwise, as viewed in FIG. 1, and moves the rod 46*a* downwardly with the result that the shoe 42*a* is disengaged from (or exerts a lesser pressure against) the periphery of the brake cylinder 41*a*. When the tension of the web 3*a* is reduced, i.e., subsequent to severing of this web by the device 17*a*, the guide roller 6*a* descends by gravity and causes the shoe 42*a* to bear against the cylinder 41*a* so that the roll 2*a* is brought to a halt. The spring 44*a* serves as a damping means in that it insures a smooth and gradual application and disengagement of the brake. The construction of the brake for the roll 2*b* is analogous; the components of this brake are designated by the same reference numerals as those denoting parts of the brake for the roll 2*a* but each followed by *b*.

The severing devices 17*a*, 17*b* comprise a common stationary counterknife 49 which is mounted on the holding device 52 for the uniting band 53, and discrete movable knives 51*a*, 51*b* which are respectively mounted on the sections 16*a*, 16*b* of the splicer 16. At least the fixed counterknife 49 is preferably provided with a serrated cutting edge. The holding device 52 is removably mounted in a support 152 and can be inserted into the support in a first position (shown in FIGS. 1–4) or in a second position (shown in FIG. 5) subsequent to turning through 180°. In accordance with a presently preferred embodiment of the invention, the holding device 52 is removably held in the support 152 by friction. The uniting band 53 constitutes a portion of a tape both sides of which are coated with a suitable adhesive. The movable knives 51*a*, 51*b* may but need not constitute integral parts of the respective sections 16*a*, 16*b*.

When the holding device 52 is mounted in a manner as shown in FIGS. 1–4, the severing device 17*b* is ineffective because the counterknife 49 is ready to cooperate with the movable knife 17*a* in order to sever the running web 3*a* behind the uniting band 53. The latter adheres to a narrow ledge or shoulder of the holding device 52 so that it can be readily separated from the device 52 when the leader 3B is attached to the band 53 so that the web 3*b* begins to advance toward the nip of the rollers 9, 11.

The trimming devices 18*a*, 18*b* respectively comprise fixed knives or cutters 54*a*, 54*b* which are preferably formed with serrated cutting edges, and mobile cutters 56*a*, 56*b* which are respectively mounted on the sections 16*a*, 16*b* of the splicer 16. The cutters 56*a*, 56*b* may but need not constitute integral parts of the respective splicer sections. The trimming device 18*a* of FIG. 1 is ineffective, i.e., it cannot sever or trim the web 3*a* because the leader of this web is not attracted to the upper side of the member 19*a*. However, a pivoting of the section 16*b* in response to downward movement of the piston rod 28 results in automatic trimming of the leader 3B because the foremost part of this leader adheres to the upper side of the member 19*b* and the leader 3B extends between the cutters 54*b*, 56*b*.

The means for monitoring the diameter of the expiring roll 2*a* comprises a photoelectric detector 57*a* which produces a signal as soon as the diameter of the roll 2*a* is reduced to a predetermined minimum value. Such signal is transmitted to the corresponding input of the control circuit 58 which disengages the clutch 12 for the driven roller 9 and transmits a signal to the valve 36 so that the latter admits compressed gas via conduit 34 with the result that the piston rod 28 moves downwardly. The control circuit 58 further transmits a signal (see the conductor means 59) which is used to insure that the blank embodying the splice between the webs 3*a*, 3*b* is removed, i.e., that such blank is not converted into the inner envelope of a cigarette pack. The conductor means 59 can transmit the signal to a suitable time-delay device (e.g., a shift register) which transports the signal in synchronism with movement of those portions of the webs 3*a*, 3*b* which are attached to each other by the band 53.

The detector for the roll 2*b* is shown at 57*b*.

Figure 2:
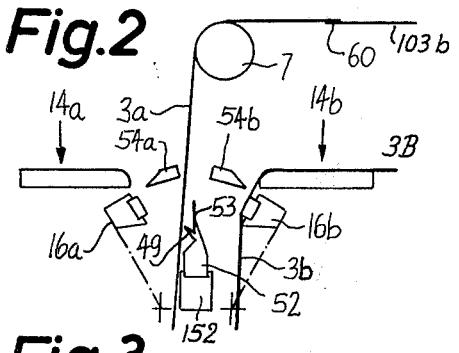
FIG. 2 illustrates the splicer in idle position.

The operation:

FIG. 2 shows the sections 16*a*, 16*b* of the splicer 16 and the holding device 52 in the same position as FIG. 1. The reference character 60 denotes a splice between the leader of the web 3*a* and a preceding web 103*b*, i.e., a web which was paid out by a roll preceding the roll 2*b*. When the detector 57*a* transmits a signal indicating that the supply of web 3*a* on the roll 2*a* is nearly exhausted, the control circuit 58 disengages the clutch 12 so that the rollers 9, 11 come to a halt and the web 3*a* ceases to move forwardly. The remnant of the roll 2*a* continues to rotate due to inertia so that the tension of web 3*a* in the region of the guide roller 6*a* is reduced.

Figure 3:
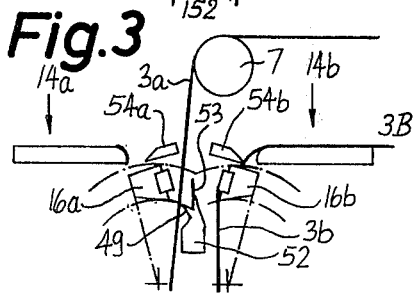
FIG. 3 illustrates the structure of FIG. 2 but with the sections of the splicer approaching each other.

This roller descends and enables the spring 44*a* to gently apply the brake by urging the shoe 42*a* against the cylinder 41*a* which arrests the roll 2*a* through the medium of the sleeve 39*a*. The control circuit 58 energizes the solenoid of the valve 36 with a slight delay following disengagement of the clutch 12. The valve 36 admits compressed gas into the upper chamber of the cylinder 32 (i.e., into the conduit 34) while the conduit 33 connects the lower cylinder chamber with the atmosphere. The piston rod 28 moves downwardly and causes the sections 16*a* 16*b* of the splicer 16 to pivot toward each other, i.e., toward the respective sides of the uniting band 53 on the holding device 52. The pivoting right-hand section 16*b* attracts the leader 3B (port or ports 23b) and thus shifts it slightly with respect to the upper side of the positioning device 14*b*. The leader 3B is severed by the cutters 54*b*, 56*b* before the section 16*b* reaches the uniting band 53. This is shown in FIG. 3.

Figure 4:
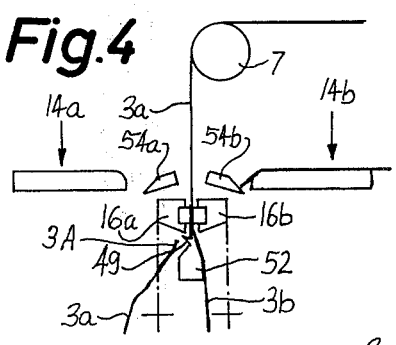
FIG. 4 illustrates the structure of FIG. 2 but with the sections of the splicer immediately adjacent to each other to press the fresh and running webs against the opposite sides of the uniting band.
Figure 5:
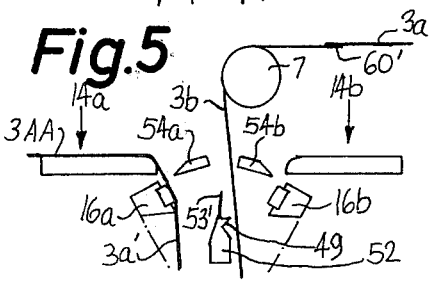
FIG. 5 shows the structure of FIG. 2 but with the holding means for uniting bands in inverted position.

The splice 60' (FIG. 5) between the webs 3*a*, 3*b* is formed when the sections 16*a*, 16*b* reach the positions shown in FIG. 4. Shortly before or at the same time, the knife 15*a* moves sufficiently close to the stationary counterknife 49 to sever the running web 3*a* behind the band 53 whereby the leader 3A of the remnant of the web 3*a* descends by gravity because the port or ports 23*a* are not connected to the suction generating means. When the sections 16*a*, 16*b* reach the positions shown in FIG. 4, the webs 3*a*, 3*b* are caused to adhere to the respective sides of the uniting band 53 on the holding device 52. The control circuit 58 thereupon causes the valve 36 to connect the conduit 34 with the atmosphere and to admit compressed gas into the conduit 33 so that the piston rod 28 moves upwardly and returns the sections 16*a*, 16*b* to the positions shown in FIG. 5 whereby the port or ports 23*b* move away from the web 3*b*. The manner in which the control circuit 58 can transmit signals to the valve 36 to actuate this valve in the aforedescribed manner is not specifically shown because it forms no part of the invention and also because such types of controls for multi-way valves are well known in the art. The control circuit 58 deactivates the detector 57*a* and activates the detector 57*b* so that the latter begins to monitor the diameter of the roll 2*b*. Also, the control circuit 58 engages the clutch 12 so that the web 3*a* is set in motion and entrains the splice 60' toward and beyond the nip of the rollers 9, 11. The web 3*b* is now the running web and the tension of this web is the region of the guide roller 6*b* increases so that the lever 47*b* pivots clockwise, as viewed in FIG. 1, and disengages the brake shoe 42*b* from the cylinder 41*b*. In order to prepare the apparatus for the next splicing operation, the person in charge removes the holding device 52, attaches thereto a fresh uniting band 53' (FIG. 5) and reinserts the device 52 into the support 152 but in inverted position. The knife 49 is then ready to cooperate with the knife 51*b* on the section 16*b* of the splicer 16. The person in charge also removes the trimmed foremost portion of the leader 3B from the member 19*b* and the remnant of the roll 2*a* and replaces this roll with a fresh roll containing a supply of web 3*a'* (FIG. 5) whose leader 3AA is threaded through the apparatus so that it comes to rest on and is attracted to the upper side of the member 19*a* as well as to the suction port or ports 23*a* which are then connected to the suction generating means. If the leader of the web 3*a'* is wrinkled or otherwise deformed, the person in charge pulls the web 3*a'* as long as necessary to insure that the web portion between the member 19*a* and section 16*a* is flat so that it can be readily spliced to the running web 3*b* in response to a signal from the detector 57*b*. Those portions of the webs 3*a*, 3*b* which form the splice 60' of FIG. 5 are removed from the packing machine in response to a signal from the control circuit 58 via conductor means 59.

An advantage of the improved apparatus is that it can be assembled of a relatively small number of parts the majority of which can be furnished in pairs. The apparatus occupies little room and can be readily serviced by semiskilled or even unskilled persons. Also, the apparatus can be used for splicing of webs consisting of stiff paper, imitation cork or other relatively strong material as well as for splicing of webs of cigarette paper, metallic foil or other highly sensitive material. Still further, the position of the leader of a fresh web is always under control because such leader is attracted by suction ports 21*a*, 23*a* or 21*b*, 23*b*. Also, the person in charge can readily insure that the leader of a fresh web will be trimmed in a region where the leader is free of wrinkles, creases or the like. All that is necessary is to pull the leader (e.g., the leader 3B of FIG. 1) until the web portion between the retracted section 16*b* and the member 19*b* is free of wrinkles; this insures that the trimming device 18*b* will automatically sever an undeformed portion of the leader 38 so that the latter can be readily spliced to the running web 3*a*.

The improved splicing apparatus is susceptible of many modifications without departing from the spirit of the invention. For example, the single actuating means 29 for the sections 16*a*, 16*b* of the splicer 16 could be replaced by two discrete actuating means which are operated in synchronism. However, the illustrated construction is preferred at this time because it is more compact and less expensive than a twin actuating arrangement. The drive 8 can advance the running web continuously or intermittently, and the running web may but need not be arrested during the making of a splice. Of course, if the advancing rollers 9, 11 are rotated at intervals, it is preferred to make a splice while the rollers 9, 11 are idle. Continuous rotation of the rollers 9, 11 is preferred when a roll (2*a*) of fresh web is extremely heavy and bulky so that it would be necessary to resort to complex accelerating and decelerating means in order to insure satisfactory intermittent transport of webs. If the splicing apparatus is to make splices while the running web is at a standstill but the nature of the web consuming machine is such that it must receive a running web at a constant speed, the apparatus preferably comprises a suitable magazine (not shown) which stores a supply of running web between the advancing rollers 9, 11 and the consuming machine so that the magazine pays out the web while the apparatus makes a splice. Such magazines are well known in the art; they normally comprise a set of rollers which loop and thereby store a substantial length of the running web downstream of the advancing rollers. If the running web is transported at a relatively low speed, the splicing operation can be performed without any deceleration of the running web, especially if the apparatus is equipped with suitable means for insuring gradual acceleration of the fresh roll prior, during or immediately subsequent to splicing.

The severing devices 17*a*, 17*b* and/or trimming devices 18*a*, 18*b* may be replaced by suitable shears which are actuated in synchronism with the sections 16*a*, 16*b* of the splicer 16. However, the illustrated severing and trimming devices are preferred because their mobile components receive motion from the actuating means 29 for the sections of the splicer.

Without further analysis, the foregoing will so fully reveal the gist of the present invention that others can, by applying current knowledge, readily adapt it for various applications without omitting features which fairly constitute essential characteristics of the generic and specific aspects of my contribution to the art and, therefore, such adaptations should and are intended to be comprehended within the meaning and range of equivalence of the claims.

What is claimed as new and desired to be protected by Letters Patent is set forth in the appended claims.

1. Apparatus for attaching a running web which is withdrawn from a first source of supply to the leader of a fresh web which is stored in a second source of supply by means of a uniting band both sides of which are adhesive, comprising means for advancing the running web along a predetermined path; first and second positioning means disposed at the opposite sides of said path, the leader of the fresh web being held by said second positioning means; first and second severing means disposed at the opposite sides of said path and being actuatable to sever the respective webs intermediate the corresponding sources and said advancing means; a splicer having first and second sections actuatable to move toward and away from each other intermediate said positioning means and said sources, said path and the leader of the fresh web being located between said sections; means for holding a uniting band so that the band is located between said sections and between the running and fresh webs; first and second trimming means disposed at the opposite sides of said path and being operable to trim the leaders of webs which are respectively held by said first and second positioning means; and means for actuating said sections and said first severing means whereby said sections attach the running and fresh webs to the opposite sides of the band and said first severing means severs the running web intermediate the uniting band and said first source, said actuating means comprising means for operating said trimming means whereby said second trimming means trims the leader of the fresh web intermediate said holding means and said second positioning means.

2. Apparatus as defined in claim 1, further comprising first and second detector means for respectively monitoring the supplies of webs in said first and second sources, and control means for respectively arresting said advancing means and for starting said actuating means in response to depletion of the supply of web in one of said sources below a predetermined minimum supply.

3. Apparatus as defined in claim 2, wherein each of said sources constitutes a roll of convoluted web and said detector means include photoelectric devices arranged to monitor the diameters of the respective rolls.

4. Apparatus as defined in claim 1, wherein each of said severing means comprises a movable knife and a fixed counterknife.

5. Apparatus as defined in claim 4, wherein the movable knives of said first and second severing means are respectively mounted on said first and second sections of said splicer.

6. Apparatus as defined in claim 1, wherein said first and second severing means comprise a fixed knife on said holding means and first and second movable knives respectively mounted on said first and second sections of said splicer.

7. Apparatus as defined in claim 6, wherein said holding means is movable between two positions in one of which said fixed knife cooperates only with said first movable knife and in the other of which said fixed knife cooperates only with said second movable knife.

8. Apparatus as defined in claim 1, wherein each of said trimming means comprises a fixed cutter and a movable cutter.

9. Apparatus as defined in claim 8, wherein the movable cutters of said first and second trimming means are respectively mounted on said first and second sections of said splicer.

10. Apparatus as defined in claim 1, wherein each of said sections comprises a hammer which strikes against the respective web in response to movement of said sections toward each other, and means for attracting a portion of the leader of the fresh web behind the respective positioning means.

11. Apparatus as defined in claim 10, wherein said attracting means includes suction ports in said hammers.

* * * * *